US006370708B1

(12) United States Patent
Sitarz et al.

(10) Patent No.: US 6,370,708 B1
(45) Date of Patent: Apr. 16, 2002

(54) TOILET TANK ANTI-REFILL DEVICE

(75) Inventors: Charles L. Sitarz, Box 7, Group 5, R.R.#2; Robert L. Sitarz, Box 48, Group 5, R.R. #2; Mark C. Sitarz, Box 52, Group 5, R.R. #2; Blaine C. Sitarz, Box 7, Group 5, R.R. #2, all of Dugald, Manitoba (CA), R0E 0K0; Pam M. Wazney, Dugald (CA)

(73) Assignees: Charles L. Sitarz; Robert L. Sitarz; Mark C. Sitarz; Blaine C. Sitarz

( * ) Notice: Subject to any disclaimer, the term of this patent is extended or adjusted under 35 U.S.C. 154(b) by 0 days.

(21) Appl. No.: 09/325,713

(22) Filed: Jun. 4, 1999

(51) Int. Cl.[7] ..... F16K 31/20; E03D 1/00

(52) U.S. Cl. ..... 4/415; 137/434; 137/435; 137/410

(58) Field of Search ..... 4/415, 661; 137/410, 137/426, 434, 435

(56) References Cited

U.S. PATENT DOCUMENTS

| | | | | |
|---|---|---|---|---|
| 1,070,820 A | * | 8/1913 | Lamont | 137/435 |
| 2,243,002 A | | 5/1941 | Cronk | |
| 3,038,491 A | * | 6/1962 | Beazley | 137/435 |
| 3,095,577 A | * | 7/1963 | Clark | 137/435 |
| 4,351,071 A | | 9/1982 | Clar | |
| 4,843,657 A | | 7/1989 | Orr | |
| 4,965,891 A | | 10/1990 | Antunez | |
| 5,211,204 A | | 5/1993 | Mikol | |
| 5,232,011 A | | 8/1993 | Royalty | |
| 5,327,931 A | | 7/1994 | Royalty et al. | |
| 5,542,448 A | | 8/1996 | Campbell et al. | |
| 5,742,951 A | | 4/1998 | Wright et al. | |
| 5,775,366 A | | 7/1998 | Ray et al. | |

* cited by examiner

*Primary Examiner*—Charles R. Eloshway
(74) *Attorney, Agent, or Firm*—Adrian D. Battison; Murray E. Thrift; Michael R. Williams

(57) ABSTRACT

A combination of a toilet and an anti refill device, the toilet comprises a bowl, a tank connected to the bowl for storing water and to supply the stored water to the bowl, a flushing structure which releases water from the tank into the bowl, a supply valve for refilling the tank with water after the flushing structure has released all the water into the bowl and a float structure for activating and deactivating the supply valve by floating in the water so that when the water is low the supply valve is activated and when the water is full the supply valve is deactivated. The anti refill device comprises a lock arm attached to the float structure and has an end, a lock device arranged to cooperate with end for controlling the lock arm and a structure activated by the flush structure which activates the lock device and the end to release the lock arm so the float arm lowers and the supply valve can fill the tank after flushing. The device is arranged to stop the float structure from activating the supply valve when the flushing structure is not activated. The lock arm is held in place by the lock device and the end such that the float structure does not activate the supply valve, wherein the end and the lock device engage to define a ratchet in which a plurality of teeth have a first side so that the lock arm slides against the lock device so that the float arm can activate the supply valve and a second side of the teeth being at an angle such that the float arm is prevented from lowering.

9 Claims, 4 Drawing Sheets

7
19A
11
19
45
41
29
53
33
39
63
67
65
27
1
77
61
69
31
71

TOILET TANK ANTI-REFILL DEVICE

FIELD OF THE INVENTION

The present invention relates to a device which prevents unwanted refilling of a tank so that excess water leakage from a toilet which has a breached tank is minimised.

BACKGROUND OF THE INVENTION

Toilet tanks on a toilet have a propensity to leak water which causes water damage to the bathroom if not noticed or the homeowner is away.

In U.S. Pat. No. 4,351,071 (Clar), U.S. Pat. No. 4,843,657 (Orr), U.S. Pat. No. 4,965,891 (Antunez), U.S. Pat. No. 5,775,366 (Ray et al), U.S. Pat. No. 5,542,448 (Campbell et al) disclose an arrangement which prevents leakage from the toilet. The above Patents discontinue the flow of water which normally refills the tank, each using a different method for stopping the flow.

U.S. Pat. No. 4,351,071 of Clar is disclosed as being a water saving device which has a secondary float means inside the tank which controls a latch member and releases a main float to allow opening of an inlet valve only after the tank has dropped by a predetermined amount.

U.S. Pat. No. 4,843,657 of Orr is disclosed as being an anti-flood toilet tank fill valve which utilises a catch mechanism arranged to catch a float means in the tank to prevent the tank from filling unless the flush lever is operated.

U.S. Pat. No. 4,965,891 of Antunez is disclosed as an invention which is used in combination with a tank valve which utilises a sleeve-like inverted cup as a float. A releasable latch means mechanically holds the float and is released by a mechanical flush motion.

U.S. Pat. No. 5,775,366 of Ray et al has a leak detent apparatus for a toilet flush valve assembly in which an inlet valve to a toilet flush tank is controlled by an inlet valve control device.

U.S. Pat. No. 5,542,448 of Campbell has a pendulum device on a float means which is disengaged from the float means when the toilet is flushed.

Some other arrangements of anti-leak devices are disclosed in U.S. Pat. Nos. 2,243,002-5,742,951-5,327,931-5, 232,011 and 5,211,204.

SUMMARY OF THE INVENTION

The average toilet tank holds approximately 2½ gallons of water which is replenished in about 60 seconds. This translates into 150 gallons of water per hour (or 3600 gallons in a 24 hour period.) that would inundate the surrounding toilet area until the water supply to the tank was manually shut off. It is quite evident how extensive the damage would be during a weekend away or even a day at work with no persons available to guard against this type of disaster. The present invention is designed to protect both homeowners and property owners from extensive water damage in the event of a breach of the integrity of the porcelain structure of the toilet tank for any reason, for example cracking, breaking and the like.

According to one aspect of the invention there is provided a combination comprising;

a toilet, the toilet having;

a bowl;

a tank connected to the bowl for storing water and to supply the stored water to the bowl;

a flushing means which releases water from the tank into the bowl;

a supply valve for refilling the tank with water after the flushing means has released all the water in to the bowl;

a float means for activating and deactivating the supply valve by floating in the water so that when the water is low the supply valve is activated and when the water is full the supply valve is deactivated;

and an anti refill device having;

a lock arm attached to the float means and has an end;

a lock device arranged to co-operate with the end for controlling the lock arm;

and a means activated by the flush means which activates the lock device and the end to release the lock arm so that float arm lowers and the supply valve can fill the tank after flushing;

the device is arranged to stop the float means from activating the supply valve when the flushing means is not activated the lock arm is held in place by the lock device and the end such that the float means does not activate the supply valve, wherein the end and the lock device engage to define a ratchet in which a plurality of teeth have a first side so that the lock arm slides against the lock device so that the float arm can activate the supply valve and a second side on the teeth being at an angle such that the float arm is prevented from lowering.

Preferably the device is mounted on a bracket which mounted onto an existing bolt in the tank and has a threaded shaft which is arranged to support the lock device.

It is preferred that the lock device has a pair of parallel horizontal arms in which each arm passes a respective side of the lock arm and wherein the arms are attached to a nut on the threaded shaft which is supported by a pair of locking nuts at respective sides of the nut on the threaded shaft.

Preferably the teeth are located on the end adjacent to the lock device and wherein the first side defines a top side of the teeth and the second side defines a bottom side of the teeth.

Preferably the means is arranged to release the lock arm from the lock device by engaging the end and causing a movement in a direction away from the lock device and the lock device has a tab which is curved upwardly and wherein the tab is arranged to engage the teeth.

Preferably the means has a shaft pivotally mounted to the lock device, wherein a weighted end on the shaft is pulled upwardly by the flushing means and wherein the flushing means has a chain and spring arrangement attached to the weighted end.

In another aspect of the present invention there is provided a combination comprising;

a toilet, the toilet having;

a bowl;

a tank connected to the bowl for storing water and to supply the stored water to the bowl;

a flushing means which releases water from the tank into the bowl;

a supply valve for refilling the tank with water after the flushing means has released all the water in to the bowl;

a float means for activating and deactivating the supply valve by floating in the water so that when the water is low the supply valve is activated and when the water is full the supply valve is deactivated;

and an anti refill device having;

a lock arm attached to the float means and has an end;

a lock device arranged to co-operate with the end for controlling the lock arm;

and a means activated by the flush means which activates the lock device and the end to release the lock arm so that float arm lowers and the supply valve can fill the tank after flushing;

the device is mounted on a bracket which mounted onto an existing bolt in the tank and has a threaded shaft which is arranged to support the lock device.

Preferably the bracket extends horizontally along a bottom of the tank from the existing tank bolt to the threaded shaft.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
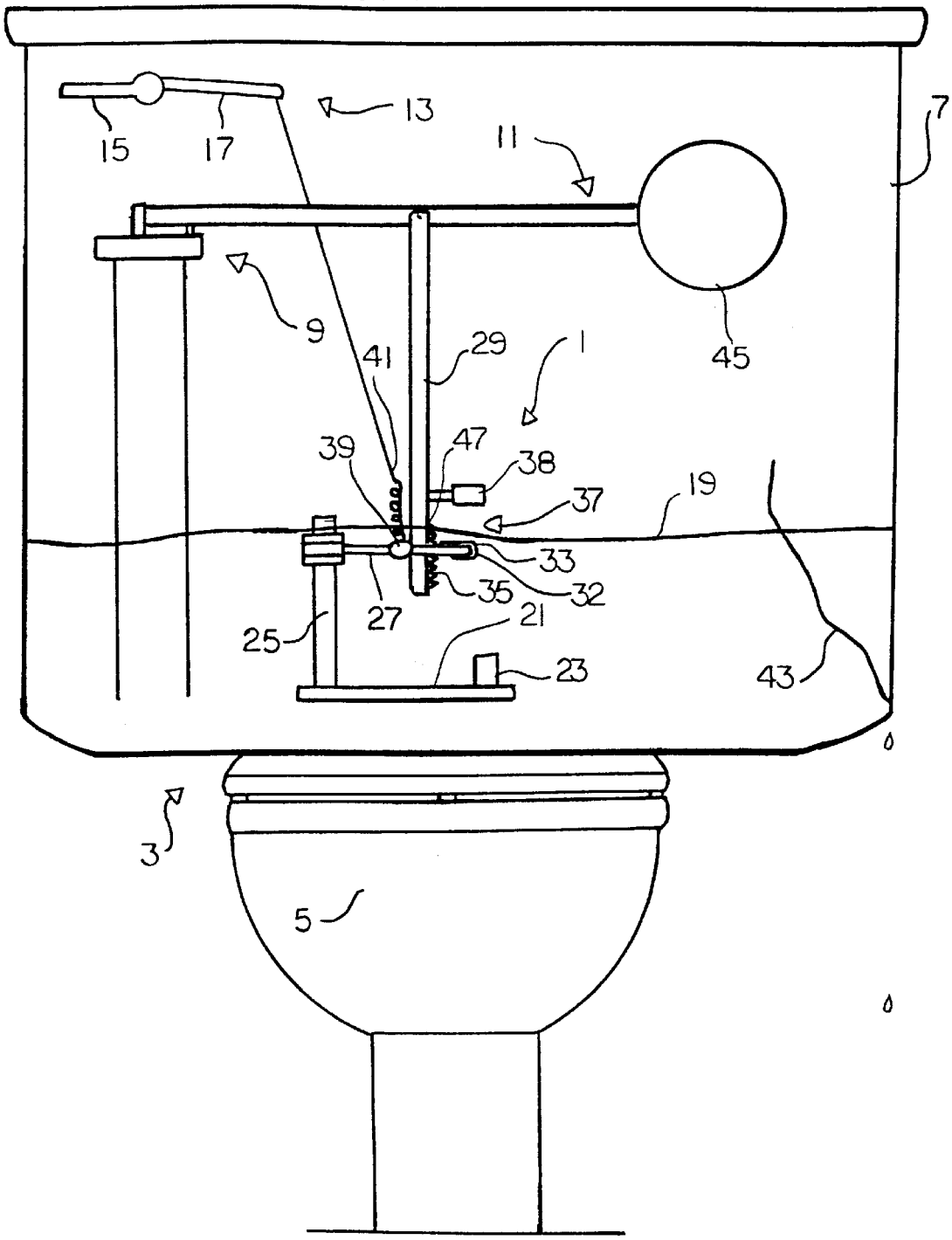
FIG. 1 is a front elevational view of the present invention.

The present invention as shown is FIG. 1 is comprised of several components. The first component is a bracket 21 which is attached at one end to the toilet tank 7 via a specially designed arrangement which is installed in place of the existing left toilet tank bolt 23. At the other end of the bracket 21 a threaded shaft 25 holds a set of forks through which a toothed arm 29 rides to effect the safety shut off. The toothed arm 29 is attached to the float arm at a specific angle and travels freely up and down with normal movement of the float 11. Also on the set of forks is an end piece 32 which serves two functions. One side houses the tripping mechanism 31, while a curved tab 33 on the other side allows the teeth 35 of the toothed arm 29 to lock into place when the float arm is in the raised or locked position 37. The tripping mechanism 31, which displaces the toothed arm 29 from the curved tab 33 when the toilet 3 is normally flushed, has a weighted end 39 with a spring and chain 41 attached to the existing flushing lever 17. A float support device 38 is mounted on the toothed arm adjacent to the teeth and is arranged to pull the toothed arm towards the tab when in the locked position and is arranged to pull the toothed arm rearward when flushed. The float support ensures a proper flush of the toilet, for example an improper flush sometimes happens when a child flushes the toilet and the handle is not pushed all the way which in some cases does not disengage the toothed arm from the tab so that the toilet does not refill. All components are fully adjustable to accommodate a wide variety of tank sizes and configurations.

The device is installed into the toilet tank 7 devoid of any interference with normal operation of the toilet or its flushing capabilities. As water fills the tank 7 after a flush, the float 11 rises with the rising water. This in turn raises the toothed arm 29 between the set of forks. As the tank 7 continues filling, the toothed arm 29 slides over the curved tab 33 and locks into position when the tank 7 is flushed, the tripping mechanism 31 displaces the toothed arm 29 from the curved tab 33 as the water level float 11 drop in the tank 7. The cycle then resumes as the device 1 returns to the locked safety position.

In event of a breach 43 of the integrity of the toilet tank 7, for example the tank 7 suddenly cracks, the water level in the tank 7 drops and releases its contents which averages about 2½ gallons. Since the device 1 has not been activated, it maintains the arm in the raised, locked position and thus no additional water is allowed entry into the tank 7 which prevents unnecessary and expensive water damage to the homeowners property. The toilet tank 7 can then be replaced with the device 1 installed to once again protect against similar situations.

As shown in FIGS. 1 through 4 the above aspects of the invention are described in detailed below.

An anti-leak device 1 for use with a conventional toilet 3, the toilet 3 having a bowl 5, a tank 7 for the storage of water for use in the bowl 5, a conventional ball-cock supply valve assembly 9 controlled by a float 11 and a flush mechanism 13, as shown in FIG. 1, is arranged to prevent unnecessary leakage from a breach in the tank 7. The ball cock supply valve 9 is arranged to provide the tank 7 with water when the flush mechanism 13 is activated. The flush mechanism 13 has a flush handle 15 which is located on the outside of the tank 7 such that the handle 15 can be engaged by an operator and a flush lever 17 which is located within the tank 7. The flush handle 15 and the flush lever 17 are located adjacently such that when the handle 15 is engaged the handle 15 is pushed downwardly and the lever 17 is forced upwardly. The flush lever 17 has a lift chain 18 which is attached to a tank ball 20 at the bottom 79 of the tank 7 such that when the lever 17 is raised the tank ball lifts allowing water to pass through an opening, for filling the bowl 5. When the water in the tank 7 is empty and the flushing and filling of the bowl 5 is completed the tank ball covers the opening such that the tank 7 is sealed. The supply valve 9 then fills the tank 7 with water. The level of water 19 is controlled by the float 11 which does this by measuring the lever of water 19. The float 11 is attached at one end to the supply valve 9 and is arranged to stop the flow of water into the tank 7 when the tank 7 has been filled to a specific amount of water 19A. The float 11 has a ball 45 at the opposite end which is arranged to float in the water. When the ball 45 is dropped, due to the release of water through the opening into the bowl 5, the supply valve 9 is engaged so that the tank 7 is refilled. When the ball 45 is raised by the refilling water the flow is stopped. If the water in the tank 7 does not reach the specific level, the ball 45 does not raise and the water flows continuously from the supply valve 9 until the flow is manually stopped.

The anti leak device 1 has a toothed arm 29 which is pivotally mounted on the float 11 and extends downwardly. The toothed arm 29 has a plurality of teeth 35 on one side of the arm at the bottom end 47 of the arm. The teeth 35 have a top face 49 which slope in a downward direction and a bottom face 51 which are perpendicular to the toothed arm. The teeth 35 are arranged to engage a tab 33, described in detail below.

Figure 4:
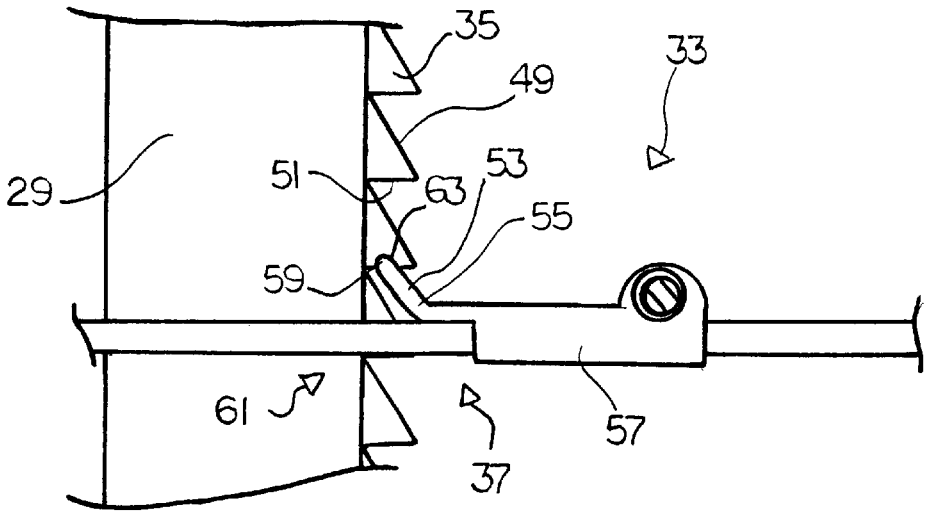
FIG. 4 is a cross section along the lines 4—4 in FIG. 3.

The tab 33, as best shown in FIG. 4, has an engage portion 53 which is arranged to engage the teeth 35 on the toothed arm. The engage portion 53 extends outwardly at an incline 55 from a main portion 57 of the tab 33. The engage portion 53 is shaped such that an outer end 59 of the engage portion 53 engages the bottom face 51 of the teeth. The upward incline 55 allows the tab 33 to lock the toothed arm 29 in a lock position 37 and allows the teeth 35 to freely travel upwardly. The tab 33 is arranged to have a ratchet action, generally located at 61, on the teeth 35 such that when the arm travels upwardly the tab 33 has a cam action along the teeth 35 and locks the arm from travelling downwardly. The outer end 59 of the engage portion 53 has an indent 63 so that the teeth 35 are positioned in the indent when in the locked position.

The tab 33 is mounted on a pair of horizontally parallel arms 27 which extend from a threaded shaft 25. The threaded shaft 25 is mounted on the opposite side of the arm from the tab 33. The parallel arms 27 extend past respective sides of the arm and are attached to the tab 33 for supporting the tab 33. A horizontal pivot arm 65 is mounted perpendicular to the parallel arms 27 and is attached to the tab 33 such that the pivot arm 65 can rotate about a horizontal axis 67. The pivot arm 65 has a tripping mechanism 31 which is arranged to release the toothed arm 29 from the tab 33.

The tripping mechanism 31 has a first portion 69 which extends downwardly from the pivot arm 65 and is curved such that a second portion 71 extends horizontally parallel with the pivot arm 65 and is arranged to engage the tooth arm. A weighted end 39 is located at the outermost end 73 of the pivot arm 65 opposite the tab 33. An extending arm 75 extends outwardly parallel with the parallel arms 27 and has a weight 77 at the end which extends outwardly parallel with the pivot arm. The weight 77 has a spring and chain 41 which extends upwardly to the flush lever 17. The tripping mechanism 31 is arranged to disengage the toothed arm 29 from the tab 33 when the toilet 3 is flushed.

To operate the tripping mechanism 31 the flush lever 17 is activated such that the weight 77 is raised such that the tripping mechanism 31 pivots so that the second portion 71 engages the toothed arm 29 so that it is released from the tab 33. When the toothed arm 29 is released from the tab 33, the float arm is allowed to lower which in turn opens the supply valve 9 filling the tank 7 with water.

The threaded shaft 25 is mounted on a bracket 21 which is located at the bottom 79 of the tank 7. The bracket 21 is mounted on a toilet bolt 23 which replaces the existing toilet bolt and wherein a nut 81 is arranged to support the bracket 21 in position and the bracket 21 can be of different lengths to accommodate different tank 7 set ups. The threaded shaft 25 has a first nut 83, a parallel arm nut 85 and a second nut 87 which are arranged to hold the parallel arms 27 in position. The threaded shaft 25 allows vertical adjustment of the parallel arms 27 therefore adjusting the height of the tab 33 such that the device 1 can accept different types and sizes of toilets.

Figure 2:
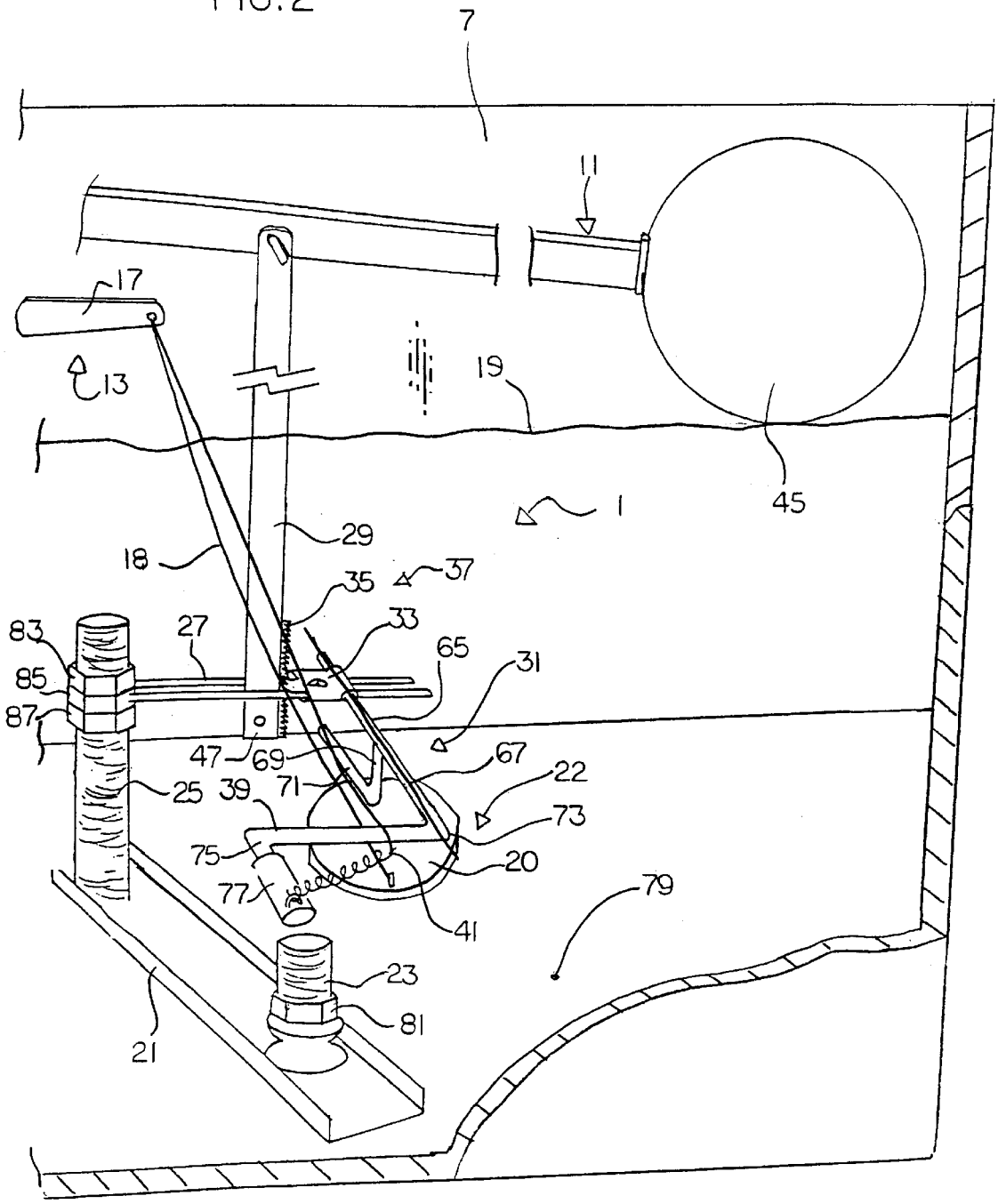
FIG. 2 is a partial isometric view of the present invention.
Figure 3:
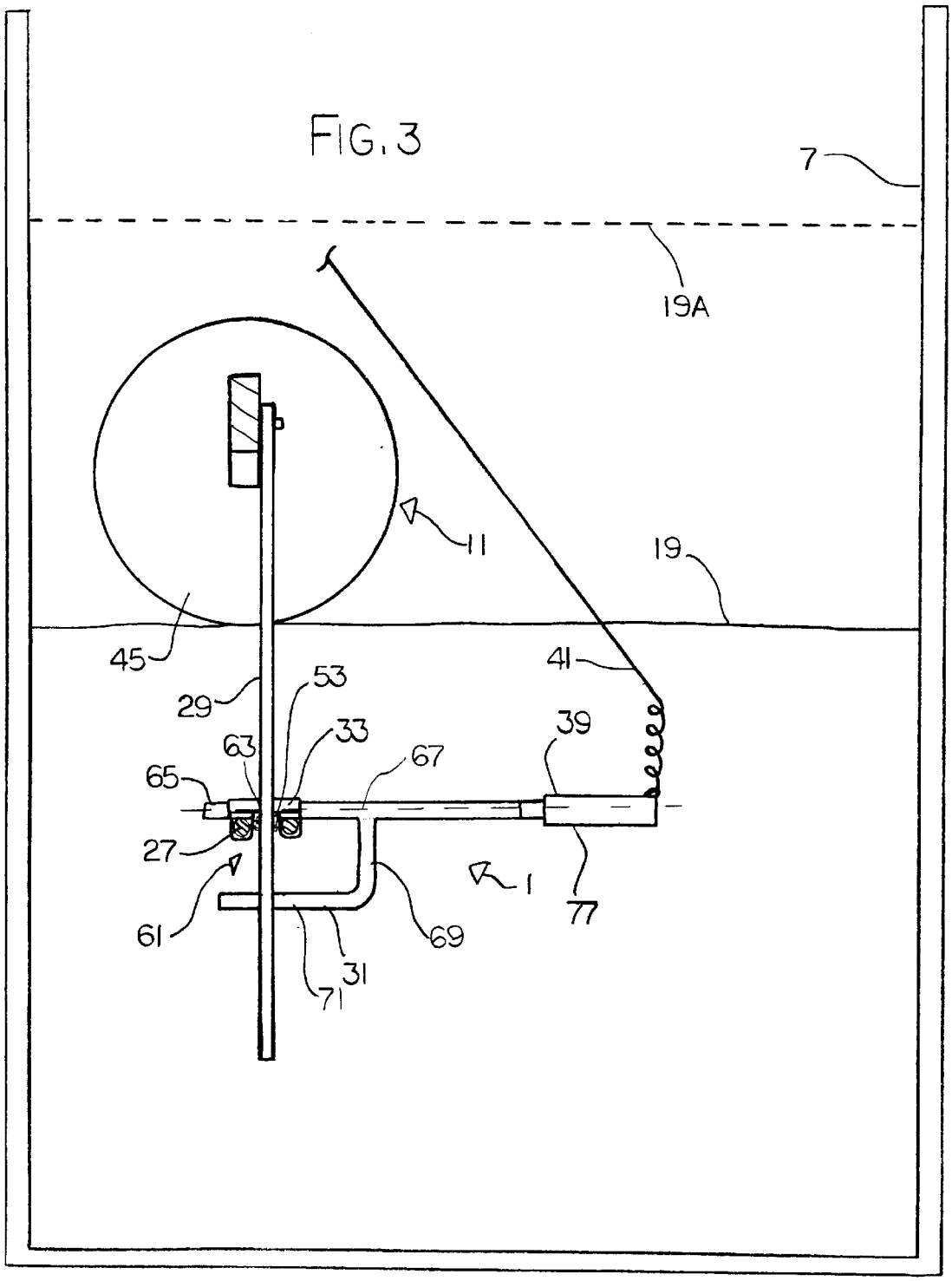
FIG. 3 is a side elevational view of FIG. 1.

As shown in FIGS. 1, 2 and 4 the toothed arm 29 is in the locked position such that the float arm is raised stopping any water entering the tank 7 from the supply valve 9. In FIG. 3 the toothed arm 29 is in the release position such that water may enter the tank 7 as described above.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A combination comprising;

a toilet, the toilet having;

a bowl;

a tank connected to the bowl for storing water and to supply the stored water to the bowl;

a flushing means which releases water from the tank into the bowl;

a supply valve for refilling the tank with water after the flushing means has released all the water in to the bowl;

a float means for activating and deactivating the supply valve by floating in the water so that when the water is low the supply valve is activated and when the water is full the supply valve is deactivated;

and an anti refill device having;

a lock arm attached to the float means and having an end;

a lock device arranged to co-operate with the end for controlling the lock arm;

and a means activated by the flushing means which activates the lock device to release the lock arm so that float arm lowers and the supply valve can fill the tank after flushing;

the lock device being arranged to stop the float means from activating the supply valve when the flushing means is not activated by holding the lock arm in place such that the float means does not activate the supply valve, wherein the end and the lock device engage to define a ratchet in which a plurality of teeth associated with the end of the lock arm have a first side so that the lock arm slides against the lock device so that the float arm can deactivate the supply valve and have a second side at an angle such that the float arm is prevented from lowering.

2. The device according to claim 1 wherein the lock device is mounted on a bracket which is mounted on a toilet bolt in the tank having a threaded shaft which is arranged to support the lock device.

3. The device according to claim 2 wherein the lock device has a pair of parallel horizontal arms in which each arm passes a respective side of the lock arm and wherein the arms are attached to a nut on the threaded shaft which is supported by a pair of locking nuts at respective sides of the nut on the threaded shaft.

4. The device according to claim 1 wherein the teeth are located on the end adjacent to the lock device and wherein the first side defines a top side of the teeth and the second side defines a bottom side of the teeth.

5. The device according to claim 4 wherein the means activated by the flushing means is arranged to release the lock arm from the lock device by engaging the end and causing a movement in a direction away from the lock device.

6. The device according to claim 4 wherein the lock device has a tab which is curved upwardly and wherein the tab is arranged to engage the teeth.

7. The device according to claim 5 wherein the means activated by the flushing means has a shaft pivotally mounted to the lock device, wherein a weighted end on the shaft is pulled upwardly by the flushing means and wherein the flushing means has a chain and spring arrangement attached to the weighted end.

8. A combination comprising;

a toilet, the toilet having;

a bowl;

a tank connected to the bowl for storing water and to supply the stored water to the bowl;

a flushing means which releases water from the tank into the bowl;

a supply valve for refilling the tank with water after the flushing means has released all the water in to the bowl;

a float means for activating and deactivating the supply valve by floating in the water so that when the water is low the supply valve is activated and when the water is full the supply valve is deactivated;

and an anti refill device having;

a lock arm attached to the float means and having an end;

a lock device arranged to co-operate with the end for controlling the lock arm;

and a means activated by the flushing means which moves the lock device to disengage the lock arm so that the float means lowers and the supply valve can fill the tank after flushing;

the lock device being mounted on a bracket which is mounted onto a toilet bolt in the tank having a threaded shaft which is arranged to support the lock device.

9. The device according to claim 8 wherein the bracket extends horizontally along a bottom of the tank from the existing tank bolt to the threaded shaft.

* * * * *